US007131306B2

(12) United States Patent
Caporusso

(10) Patent No.: US 7,131,306 B2
(45) Date of Patent: Nov. 7, 2006

(54) BENDING MACHINE DIE PROVIDED WITH A VISE FOR CLAMPING AN ELONGATED WORKPIECE TO BE BENT

(75) Inventor: Alessandro Caporusso, Piedimonte San Germano (IT)

(73) Assignee: CML International S.p.A., San Germano (IT)

( * ) Notice: Subject to any disclaimer, the term of this patent is extended or adjusted under 35 U.S.C. 154(b) by 0 days.

(21) Appl. No.: 11/195,660

(22) Filed: Aug. 3, 2005

(65) Prior Publication Data

US 2006/0027008 A1 Feb. 9, 2006

(30) Foreign Application Priority Data

Aug. 5, 2004 (IT) ..... MI2004A0402

(51) Int. Cl.
*B21D 7/04* (2006.01)

(52) U.S. Cl. ..... 72/149; 72/159

(58) Field of Classification Search ..... 72/156, 72/159, 149, 310, 460
See application file for complete search history.

(56) References Cited

U.S. PATENT DOCUMENTS 2,956,609 A 10/1960 Shaw, Jr.
3,296,849 A 1/1967 Pahl et al.
3,545,247 A * 12/1970 Fazzani ..... 72/310
5,220,818 A 6/1993 Hansen et al.

* cited by examiner

*Primary Examiner*—Derris H. Banks
*Assistant Examiner*—Debra Wolfe
(74) *Attorney, Agent, or Firm*—Young & Thompson

(57) ABSTRACT

A vise for clamping an elongated workpiece to be bent on a die (2) of a bending machine includes a movable jaw (35), provided with a clamping portion (51) approachable to and removable from the circumferential groove (4) of the die (2). The movable jaw (35) has a pivoting end (7) and a retaining end (8) opposite to the pivoting end (7). The pivoting end (7) is rigidly connected to a spindle (9) rotatable about an axis (X) at right-angles to the rotation axis (Y) of the die (2), so that the clamping portion (51) of the movable jaw (35) is displaced by an operating device (90) from an opened position, far from the elongated workpiece to be bent, to a closed position in which the clamping portion (51) mates with the elongated workpiece. A retaining device (28) is able to grip the retaining end (8) of the movable jaw (35) and to maintain the movable jaw (35) in its closed position.

14 Claims, 11 Drawing Sheets

BENDING MACHINE DIE PROVIDED WITH A VISE FOR CLAMPING AN ELONGATED WORKPIECE TO BE BENT

BACKGROUND OF THE INVENTION

1. Field of the Invention

The present invention relates to a bending machine die provided with a vise for clamping an elongated workpiece to be bent.

2. Description of Related Art

A vise close to that one described below is produced by Jesse Engineering in Tacoma, Wash. (USA). The vise of Jesse Engineering is installed by a support member on the top of a die of a bending machine. Such a support member frontally holds a pivoting axis located above a die groove. A jaw is mounted swinging about this pivoting axis. The clamping portion of the jaw is under the pivoting axis, and above the latter there is a connection to the rod of a hydraulic cylinder mounted behind on the same support member of the jaw.

A clamping vise of the type above mentioned is certainly effective for elongated workpieces, also called tubes below, that are a small diameter and then capable of being deformed by a low deformation work.

However, if one considers that what retains a tube in the die groove is the cylinder rod urging on the jaw, it should be understood that it is only the hydraulic cylinder to counteract an opening of the same jaw. Actually, the hydraulic cylinder chosen by Jesse Engineering is not small and occupies great space in the working zone of the bending machine.

The present invention aims to overcome these drawbacks.

SUMMARY OF THE INVENTION

In particular, an object of the invention is to assure a firm, reliable automatic clamping of an elongated workpiece to be bent against a die also for great tubes.

Another object of the invention is to reduce a space necessary to clamp a tube to be bent also for great tubes.

The above and other objects are achieved by a bending machine die provided with a vise for clamping an elongated workpiece to be bent, said die having a circumferential groove between its lower and upper sides, the vise comprising a movable jaw provided with a clamping portion approachable to and removable from the circumferential groove of the die, the clamping portion of the movable jaw and the groove of the die having concave profiles adapted to surround, from opposite parts, an elongated workpiece to be bent, characterized in that the vise comprises:

the movable jaw, having a pivoting end and a retaining end opposite to the pivoting end, the pivoting end, located lower down the elongated workpiece to be bent, being rotatable about an axis at right-angles to the rotation axis of the die, so that the clamping portion of the movable jaw of the vise is displaced from an opened position, far from the elongated workpiece to be bent, to a closed position in which the clamping portion mates with the elongated workpiece, and vice versa; and a retaining device able to grip the retaining end of the movable jaw and to maintain the movable jaw in its closed position.

The present invention will be described with reference to its preferred embodiments in connection with the accompanying drawings.

DESCRIPTION OF THE PREFERRED EMBODIMENTS

Figure 1:
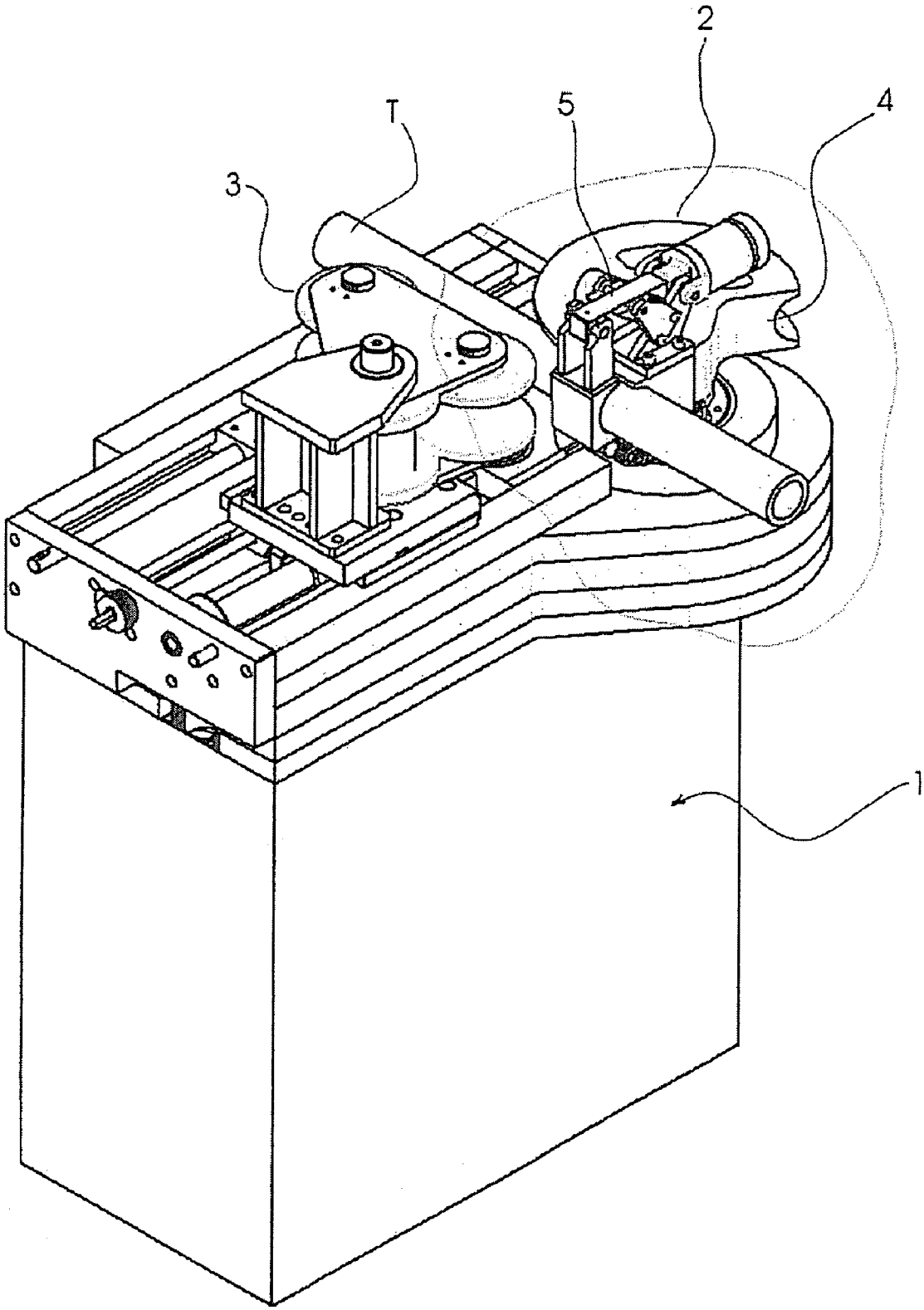
FIG. 1 is a perspective view of a a first embodiment of a bending machine die according to the invention which is provided with of a vise for clamping an elongated workpiece.

With reference to the drawings, in FIG. 1 a known bending machine, in which a bending machine die according to the present invention is embodied, is shown. A die 2 and a group of counteracting rollers 3 for a tube T to be bent are pointed out in the bending machine 1. The tube T is locked in a die groove 4 by a vise 5.

Figure 2:
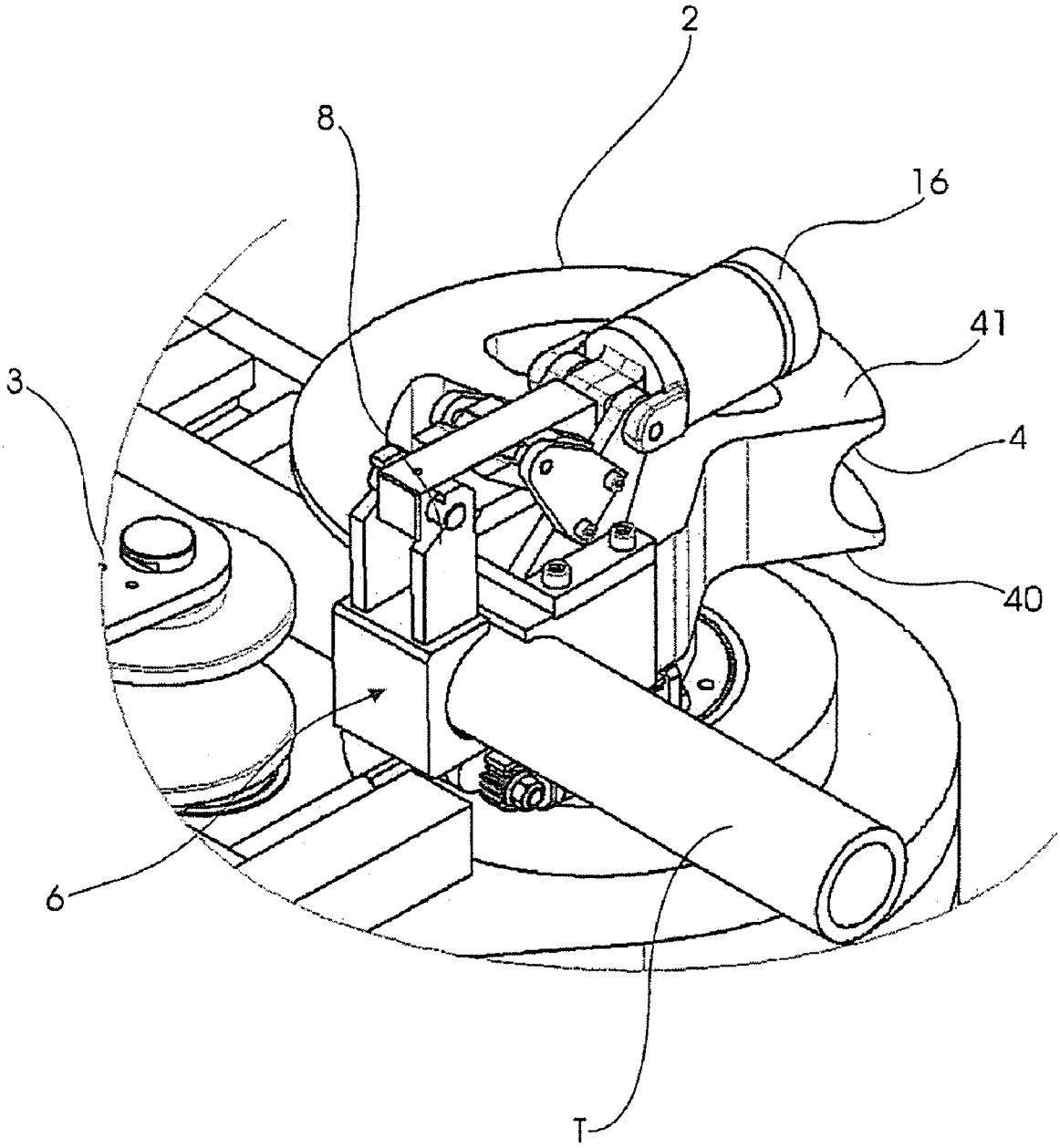
FIG. 2 shows an enlarged detail in FIG. 1.
Figure 3:
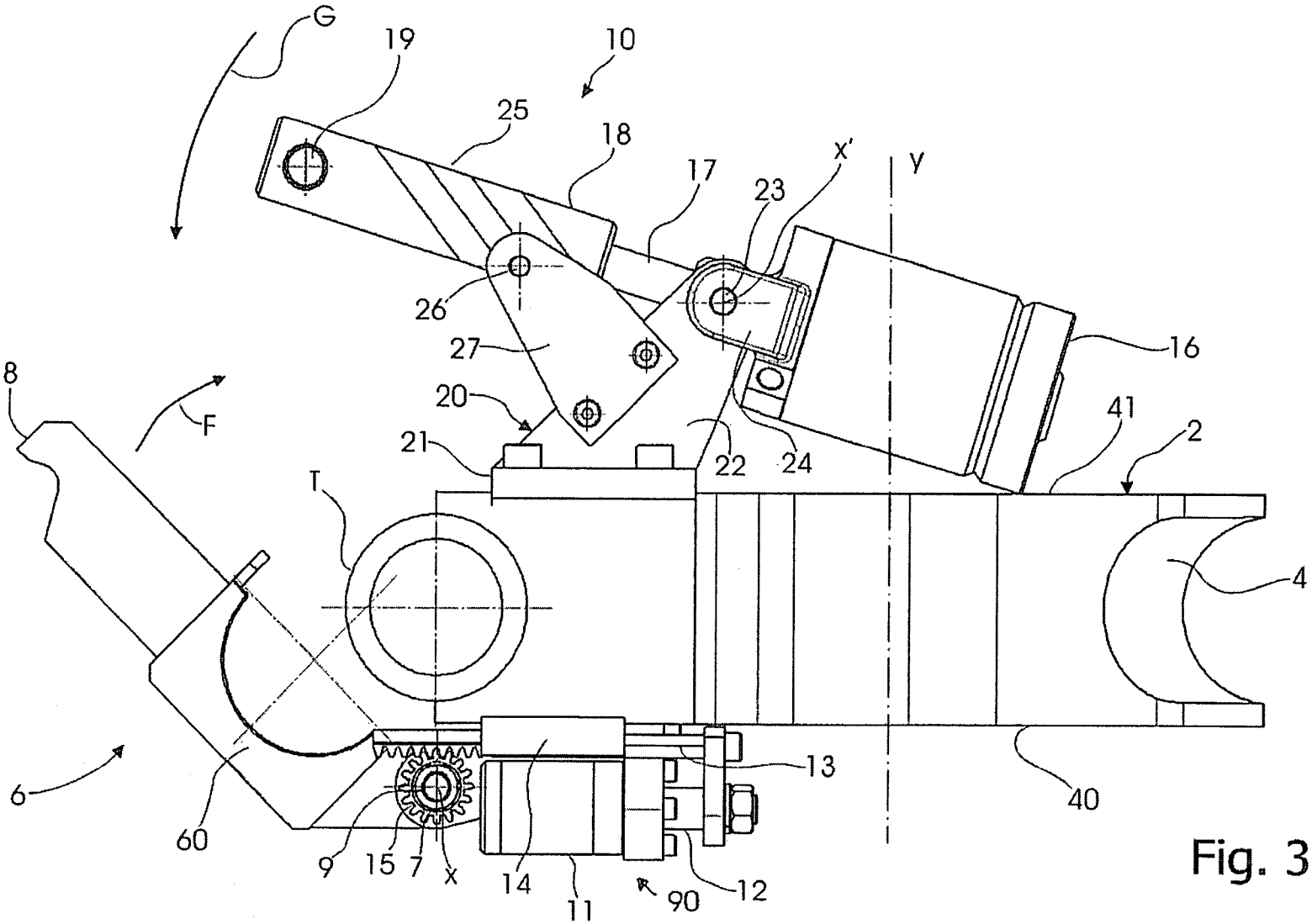
FIG. 3 shows in a side elevational view the clamping vise in FIGS. 1 and 2 in an opened position.
Figure 4:
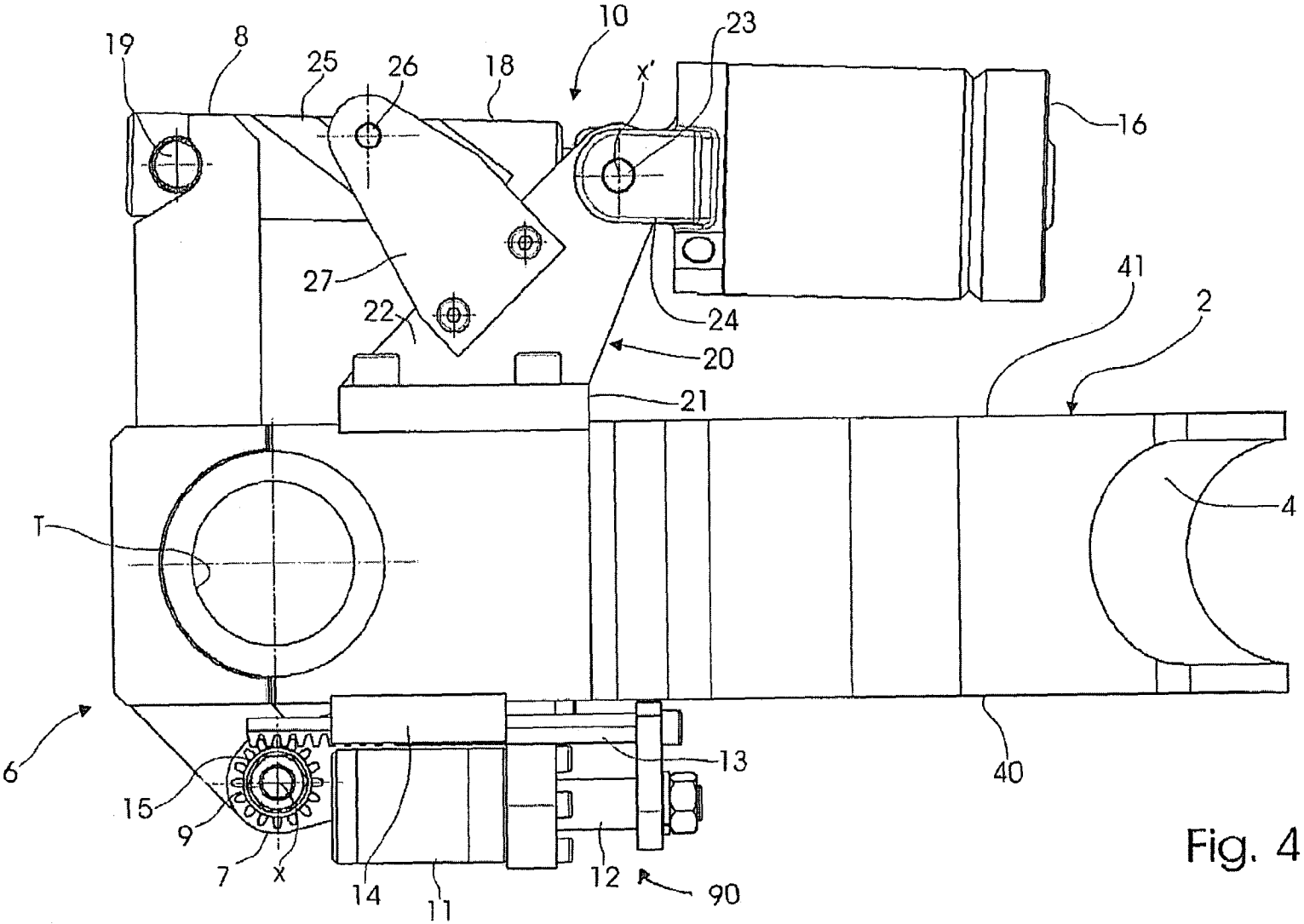
FIG. 4 shows in a side elevational view the clamping vise in FIGS. 1 and 2 in a closed position.
Figure 6:
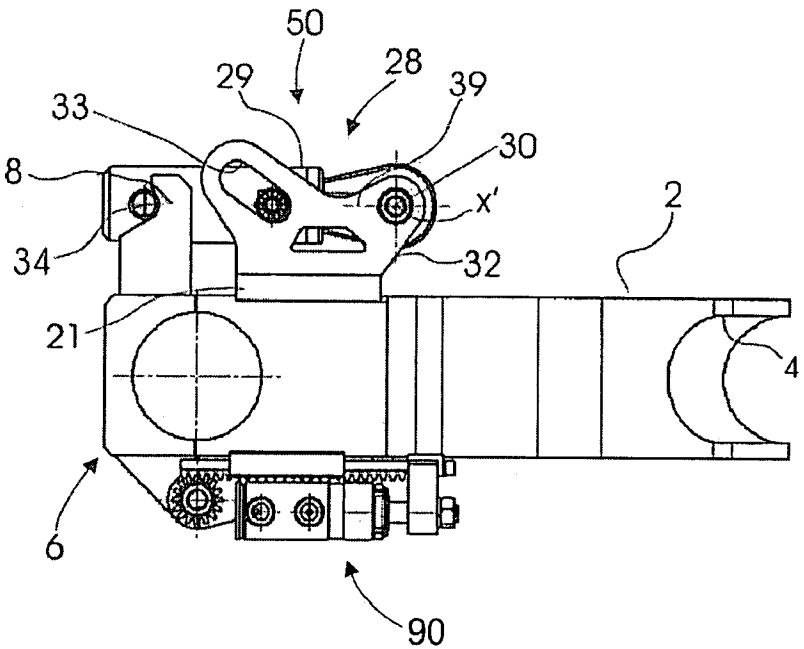
FIGS. 5 and 6 show in a side elevational view a second embodiment of a bending machine die according to the invention with a clamping vise in opened and closed positions, respectively.
Figure 5:
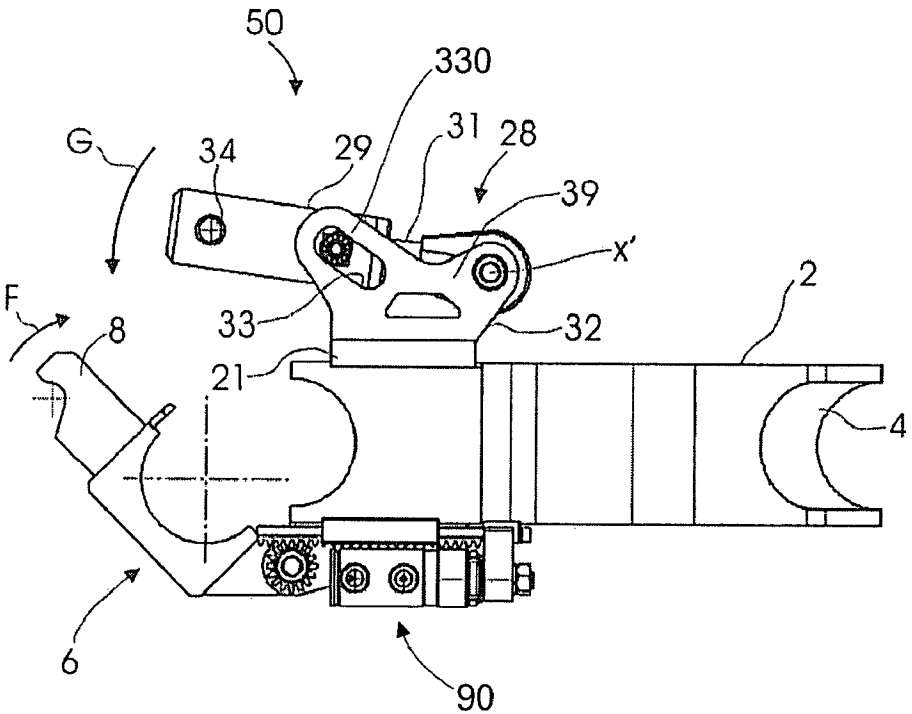

The vise 5 can be best shown in its perspective and side views in FIGS. 2 to 4. The vise 5 comprises a movable jaw 6, having a pivoting end 7 and a retaining end 8 opposite to the pivoting end 7. The movable jaw 6 rotates about an axis X at right-angles to a rotation axis Y of the die 2. The axis X is located lower down with respect to the elongated workpiece to be bent. In order to rotate about the axis X it is sufficient for the movable jaw 6 to be pivoted about a fixed spindle supported by the die. For safety reasons of a worker employed on the machine, it is desirable for the pivoting end 7, as shown in FIGS. 1 to 8, to be rigidly connected to a spindle 9 rotatable about the axis X, on which a remote-controlled operating device 90, as described below, can operate. The rotary spindle 9 is mounted by a rotary coupling with housings being fixed to the die 2, in the lower side 40 of the latter.

A retaining device generally indicated as 10 is adapted to grip the retaining end 8 of the movable jaw 6, which is suitably recessed in its side facing outwards, and to keep the movable jaw 6 in a closed position. The movable jaw 6 has a central portion 60 provided with a groove for engaging the tube T.

The operating device 90 of the movable jaw, which allows the jaw 60 to be rotated away from and towards the die groove 4, is joined to the die 2. The operating device 90 comprises a fixed hydraulic cylinder 11 connected to the lower side 40 of the die 2. Connected to the rod 12 of the fixed cylinder 11 is a rack 13 slidingly mounted in a guide 14, which is also fixed to the lower side 40 of the die 2. The rack 13 is slidable at right-angles to the axis X of the pivoting spindle 9 of the movable jaw 6. The rack 13 engages a pinion 15 keyed to the pivoting spindle 9.

By operating the hydraulic cylinder 11 the movable jaw 60 is rotated about the axis X towards and away from the groove 4 of the die 2, and then the tube T received inside the groove 4. The operating device 90 described for the movable jaw can be replaced by another equivalent device, for example a lead screw mechanism, a motor, a cam and cylinder device, etc.

The retaining device 10 of the movable jaw 6 comprises a second hydraulic cylinder 16 that is mounted on the upper side 41 of the die 2 in a swinging way. The hydraulic cylinder 16 is fed by a hydraulic reservoir not shown. The rod 17 (FIG. 3) of the hydraulic cylinder 16 is provided with a prismatic portion 18 holding at its end pins 19 projecting from both sides and engaging the recessed retaining end 8 of the movable jaw 6. Arrows F and G indicate the movement of the movable jaw 6 and the retaining device 10 respectively, to fully close the vise. The retaining end 8 is suitably shaped as a hook for receiving pins 19.

The swinging hydraulic cylinder 16 is sustained by a support member generally designated as 20. The support member 20 has a base plate 21 for the mounting on the upper side 41 of the die 2, and sustaining elements 22, which extend from the base plate 21 and are adapted to sustain the hydraulic cylinder 16 in a swinging way. The hydraulic cylinder 16 is sustained thanks to a pivoting axis X' for swinging the hydraulic cylinder 16. The pivoting axis X' is embodied in gudgeons 23 passing through holed trunnions 24 projecting from the hydraulic cylinder 16 at its end towards the cylinder rod 17 thereof.

The support of the hydraulic cylinder 16 is completed by guiding means to guide the pins 19 in their location into the retaining end 8 of the movable jaw 6. Such a guiding means includes a groove 25 made on both opposite sides of the prismatic portion 18 of the cylinder rod 17. Grooves 25 are designed to receive respective studs 26 connected to the support members 20 by means of gusset plates or brackets 27. Each groove 25 can be made, as shown in FIGS. 1 to 4, by a pair of parallel projections, but equivalent alternates can also be provided for.

With reference to FIGS. 5 to 8, which are side and perspective views, there is shown a second embodiment of a bending machine die according to the present invention provided with a vise 50 whose retaining device is generally indicated at 28. In FIG. 5 to 8 parts similar to those in FIGS. 1 to 4 are designed by like reference numerals. The movable jaw is substantially equal to the jaw 6 described in the first embodiment, except for an alternate that will be seen below. What is different is the retaining means that will be described in detail.

In this second embodiment the pivoting axis X' for swinging the hydraulic cylinder 29 comprises a pivot 30 passing through the cylinder rod 31 and engaging coaxial holes in sustaining means, indicated as 32, of the whole support 39.

A guiding means for the swinging hydraulic cylinder 29 includes a guide 33 symmetrically provided on both retaining elements 32 of the support. The guide 33 is in the form of an elongated slot.

Pivots 330, which are radially projecting from opposite parts of the cylinder 29, are slidable inside the guide 33. Analogously pins 34 engaging the retaining end 8 of the movable jaw 6 are made radially projecting from the hydraulic cylinder 29.

Figure 7:
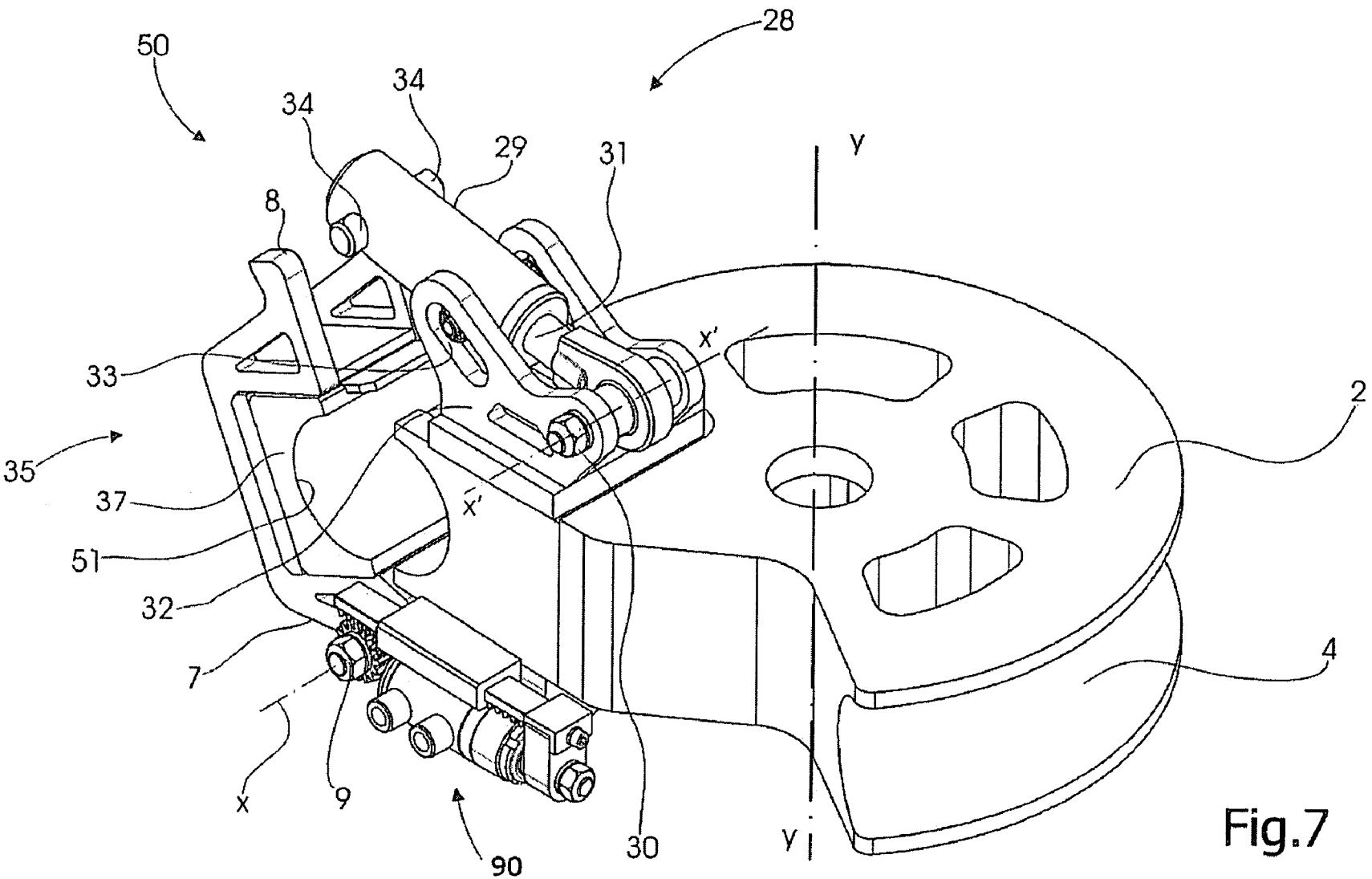
FIG. 7 is a perspective view of a first alternate of a jaw in the second embodiment of the bending machine die according to the present invention.
Figure 8:
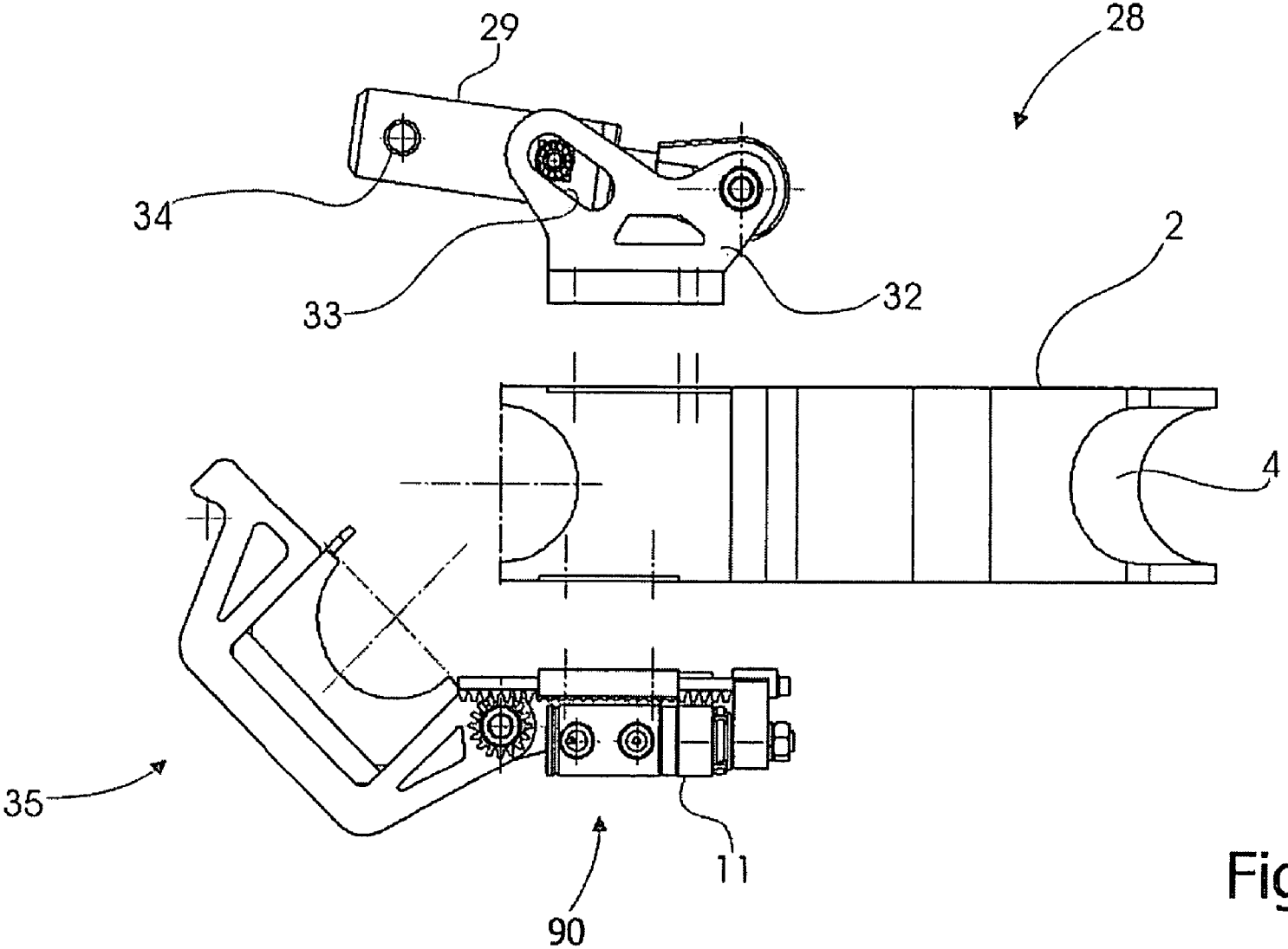
FIG. 8 shows in an exploded side elevational view the alternate in FIG. 7.
Figure 9:
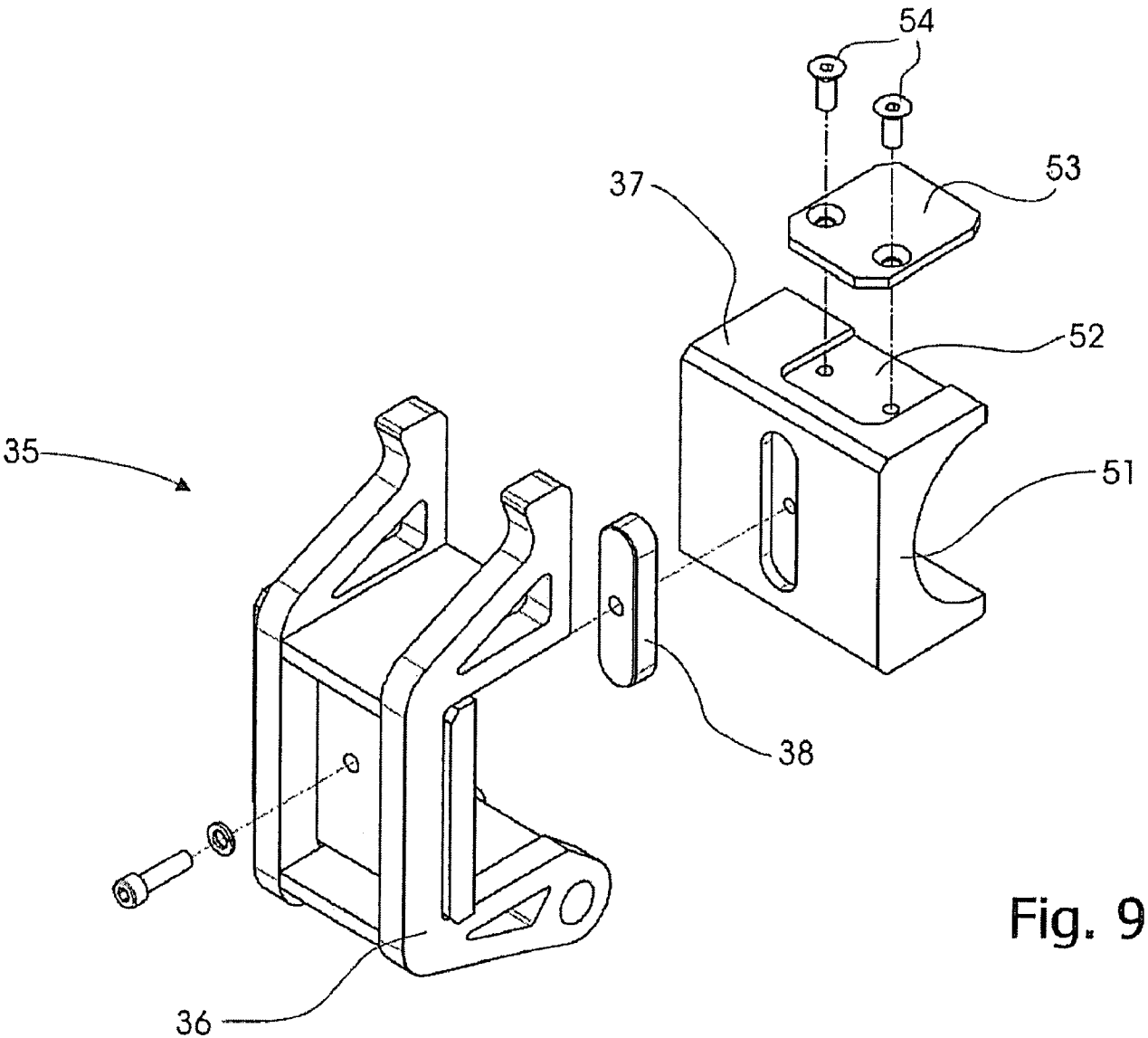
FIG. 9 shows in an exploded perspective view the alternate of jaw in FIG. 7.

The second embodiment of the bending machine die is more advantageous than the first one as it is less cumbersome and equally effective with respect to the first one. With reference to FIGS. 7 to 9, particularly to FIG. 9, which is a perspective view, there is shown a first alternate of the movable jaw generally indicated as 35, which is different from the preceding movable jaw 6 in the second embodiment according to the invention. The movable jaw 35 includes a generally U-shaped jaw element 36, inside which the clamping portion 51 is formed in an insert 37 releasably connected to the jaw element 36 by a key 38.

The insert 37 is retained on the die 2 by means of a prismatic coupling performed on at least a side of the insert 37. On this side a seating 52 for a plate 53, frontally projecting from the side of the insert 37 where the plate 53 is fixed by screws 54. The projecting plate 53 is designed to be received with its frontal edge in a facing seating (not designated by any reference numeral) made in the die 2, on its upper side 41. When the movable jaw 35 has been completely approached to the die 2, both of them are latched together, and this is useful to increase a resistance of the vise to the axial stresses to which the elongated workpiece or tube T to be bent is subjected.

The insert 37 is interchangeable with other inserts having clamping portions 51 with a different internal diameter. This allows the same vise, which is easily disassembled as shown in FIG. 8, to be used to clamp different tubes on relative dies. This possibility makes universal the vise in its use.

Figure 10:
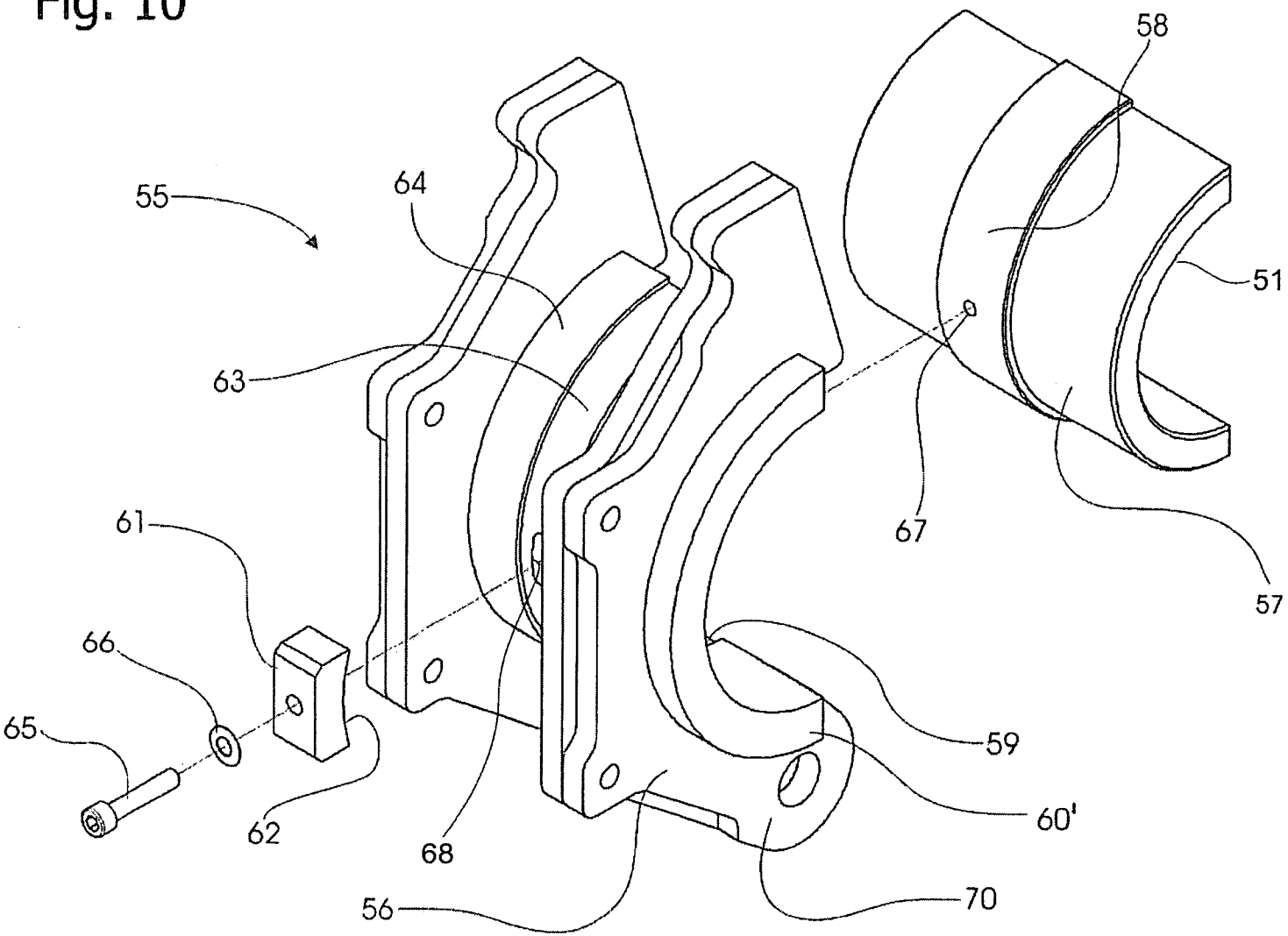
FIG. 10 is an exploded perspective view of a second alternate of a jaw in the second embodiment of the bending machine die according to the present invention.
Figure 11:
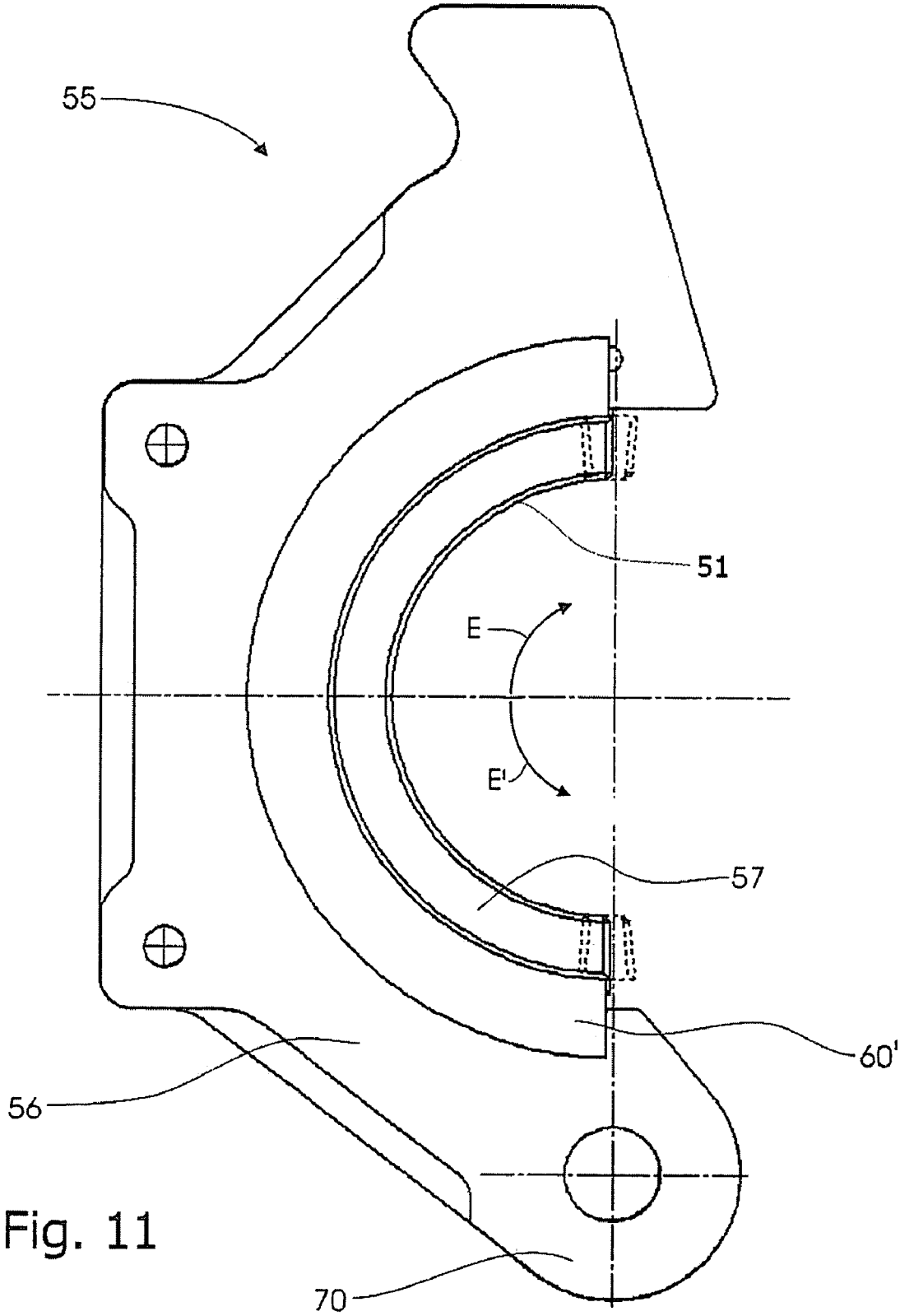
FIG. 11 shows in a side elevational view the alternate of a jaw in FIG. 10.

With reference to FIGS. 10 to 11, which are an exploded perspective view and a side view respectively, there is shown a second alternate of the movable jaw generally indicated as 55, which is different from the preceding movable jaw 35. The movable jaw 55 includes a jaw element 56, which is e.g. comprised of omega-shaped plates juxtaposed and side by side one of the other for retaining internally a half sleeve 60'. Mounted inside the half sleeve 60' is the clamping portion of the movable jaw which is formed in a half-tubular insert 57 being conformed and coaxial to the half sleeve 60'. The half-tubular insert 57 is externally provided with a half-circumferential projection 58 designed to be housed into a recess 59 which is made in conformity and in correspondence with the projection 58 inside the half sleeve 60'. The projection 58 and the recess 59, which are shown as having a step-like cross-section, act as a circumferential sliding guide of the insert 57 with respect to the half sleeve 60'. Thereby the half-tubular insert 57 can perform rotations with respect to the half sleeve 60'. As seen from the alternate shown in FIG. 10, these rotations are restricted. In fact, a threaded hole 67 is made centrally in the half-tubular insert 57, and a through slot 68 is also made centrally in the half sleeve 60'. A small block 61 is screwed by a screw 65 and a washer 66 to the threaded hole of the insert 57, the screw passing through the slot 68 of the half sleeve 60'. The small block 61 has its surface 62 facing the half sleeve 60', surface 62 that is in conformity with a guide groove 63 formed therein. Thus, a screw lock limiting the relative rotation or swinging of the insert 57 with respect to the half sleeve 60' is achieved.

This alternate of a jaw has many advantages. The half cylindrical shape of the insert 57 facilitates the manufacture thereof and reduces the waste of material. In use the insert fits best to the tube to be clamped and follows any offset, eccentricity and other defects thereof. Further, in the rotation of the jaw 55 for clamping the tube, when the insert 57 swings, also by few degrees, as shown with dash lines in FIG. 11, according to arrows E or E', the initial approach of the jaw to the tube, occurring in the rotation about the lower end 70, is adjusted in the best way, so that premature contacts, that either are detrimental to the tube clamping or damage the tube, are prevented. Axial stresses that the tube exerts on the movable jaw in a bending operation can be counteracted by partially extending the ends of the half sleeve 60' in order to constitute abutments against corresponding projections provided on the die 2. This arrangement, which can be performed also inversely, i.e. with projections in the die 2 interacting with the half sleeve 60', is not shown in figures, as it is easily made by the skilled in the art.

Figure 12:
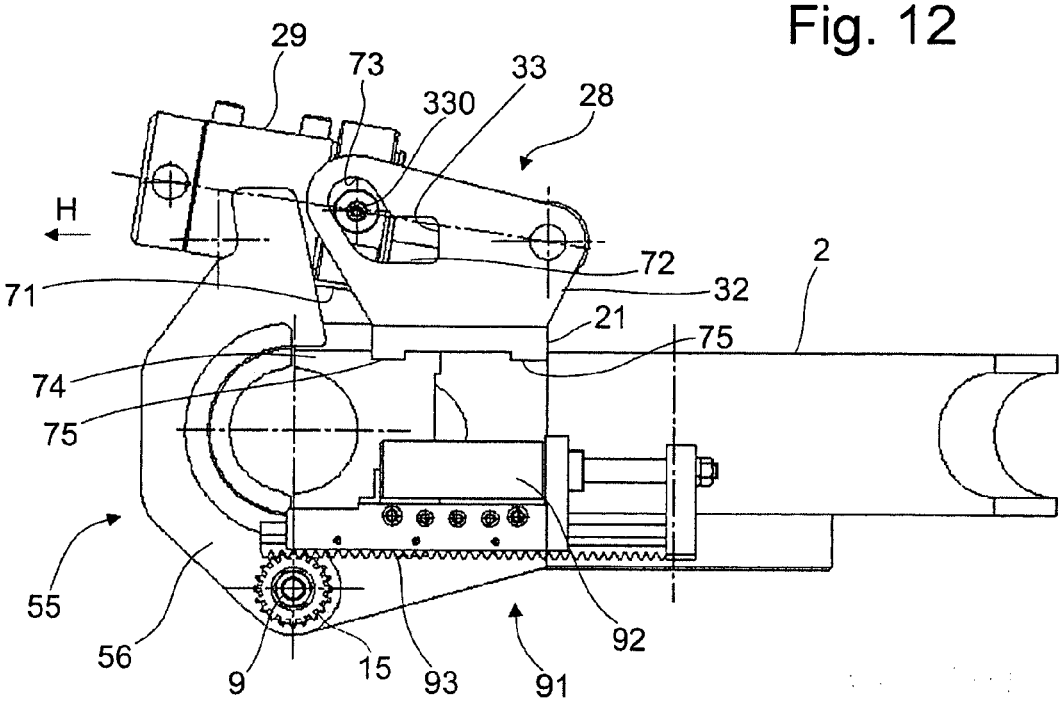
FIGS. 12 and 13 are a fragmentary side view and a front side view respectively, of a second modified embodiment of the bending machine die according to the present invention.
Figure 13:
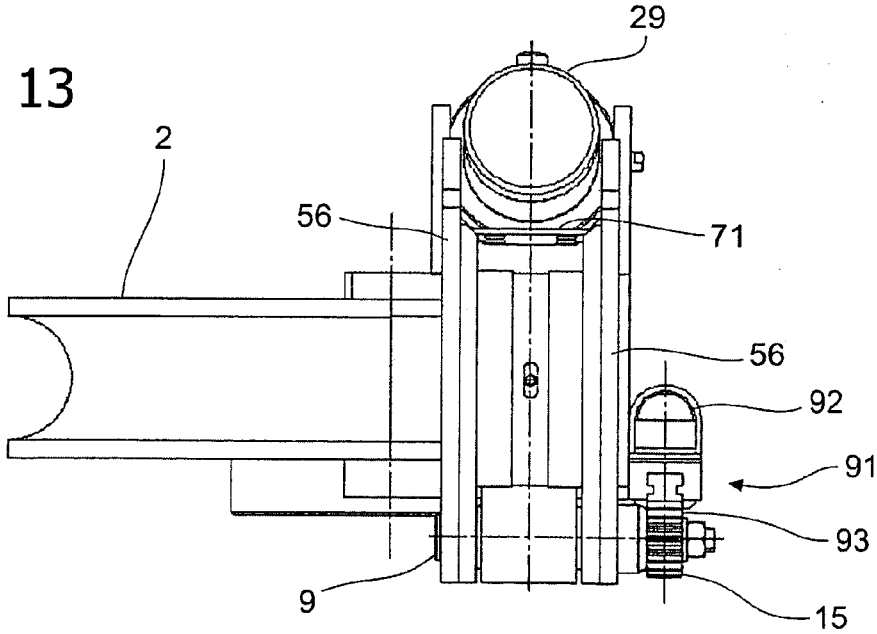

Reference is made now to FIGS. 12 and 13, which are a side view and a front view respectively, of a second modified embodiment of bending machine die according to the present invention. In this modified embodiment equal or similar parts, which are indicated by the same reference numerals as those of the embodiment depicted in FIGS. 5 to 8, are not described again. Rather, attention is drawn to a thrusting lug 71 that is provided rigidly projecting from the hydraulic cylinder 29 so that the thrusting lug 71 faces the upper end of the movable jaw 55. Thereby, while the hydraulic cylinder 29 is between the omega-shaped plates 56, the thrusting lug 71 is situated in front of the omega-shaped plates 56. The thrusting lug 71 works as follows.

Once a tube is bent, when it has to be taken of the die, it may occur that residual stresses in the tube interact with the vise hindering the opening movement of the movable jaw 55 since the latter has been released from the retaining device 28, by means of an operating device 91 similar to the operating device 90 above described and similarly positioned.

To this end the hydraulic cylinder 29 is forwarded along the arrow H by means of pivots 330 diametrally projecting from the cylinder 29 and sliding through the guide 33. Advantageously the guide 33 is made angular so that it has a substantially horizontal axis slot portion 72 and a sloping slot portion 73. Thus, already in a first travel of the hydraulic cylinder 29 in the direction of the arrow H, coaxial to the axis of the slot portion 72, the thrusting lug 71 thrusts the movable jaw 55 to remove it from the die 2 in an opening operation of the movable jaw 55. Then the movable jaw 55 rotates downwards by the operating device 91. It should be clear that a slightest displacement of the movable jaw 55 is sufficient to achieve a disconnection thereof from the tube T.

This disconnection reduces greatly the opening action performed by the operating device 91.

Referring again to FIGS. 12 and 13, one can appreciate that the fixed jaw on the die is made as an insert 74. In order that the insert 74 is better retained to the die 2, the base 21 of the sustaining means 32 is shaped as a channel. Flanges 75 of the channel-shaped base 21 are designed to fit in correspondent grooves of both the insert 74 and the die 2.

The operating device 91 is depicted as the operating device 90. However the operation device 91 is comprised of a hydraulic cylinder 92 and a rack 93, but to facilitate the construction and reduce sizes the mutual positions are inverted with respect to the operation device 90.

It should be clear that, by using the thrusting lug 71, the hydraulic cylinder 92 of the operation device 91 could be also a single-acting cylinder, as the rotation of the movable jaw 55 away from the die 2, i.e. the opening of the movable jaw 55, can happen for the gravity.

In the preceding description illustrative but not limiting embodiments of the invention have been given, which is defined in the enclosed claims.

What is claimed is:

1. A bending machine die provided with a vise for clamping an elongated workpiece to be bent, said die having a circumferential groove between its lower and upper sides, the vise comprising a movable jaw provided with a clamping portion approachable to and removable from the circumferential groove of the die, the clamping portion of the movable jaw and the groove of the die having concave profiles adapted to surround, from opposite parts, an elongated workpiece to be bent, characterized in that the vise comprises:

the movable jaw, having a pivoting end and a retaining end opposite to the pivoting end, the pivoting end, located below the elongated workpiece to be bent, being rotatable about an axis at right-angles to the rotation axis of the die, so that the clamping portion of the movable jaw of the vise is displaced from an opened position, far from the elongated workpiece to be bent, to a closed position in which the clamping portion mates with the elongated workpiece, and vice versa; and a retaining device able to grip the retaining end of the movable jaw and to maintain the movable jaw in its closed position.

2. A bending machine die according to claim 1, characterized in that the displacement of the clamping portion of the movable jaw of the vise from its opened position, far from the elongated workpiece to be bent, to its closed position in which the clamping portion mates with the elongated workpiece, is performed by an operating device of the movable jaw joined to the die, comprising:

a first hydraulic cylinder, fixed to a first side of the die and having, connected to its cylinder rod, a rack slidingly mounted perpendicularly to the axis of a spindle, which is rigidly connected to the pivoting end of the movable jaw and is pivotably mounted in seatings fixed to the die; and a pinion being keyed to the spindle of the movable jaw and meshing with said rack.

3. A bending machine die according to claim 2, characterized in that said first side of the die is the lower side of the die.

4. A bending machine die according to claim 1, characterized in that said retaining device of the movable jaw, joined to the die, comprises:

a second hydraulic cylinder provided with pin means to engage the retaining end of the movable jaw; and a support for said second hydraulic cylinder, comprising a base plate for its mounting on a second side of the die, opposite to the first side, and sustaining elements, which extend from said base plate, are able to sustain in a swinging way the second hydraulic cylinder and are provided with a pivoting axis for swinging said second hydraulic cylinder, and with guide means to guide the location of pin means of the second hydraulic cylinder with respect to the retaining end of the movable jaw.

5. A bending machine die according to claim 4, characterized in that said second side of the die is the upper side of the die.

6. A bending machine die according to claim 4, characterized in that:

the pivoting axis for swinging said second hydraulic cylinder comprises gudgeons passing through holed trunnions projecting from the second hydraulic cylinder at its end towards the cylinder rod thereof;

guiding means includes a groove made on both opposite sides of the prismatic portion of the cylinder rod, grooves being designed to receive respective studs connected to said sustaining elements; and pin means to engage said retaining end of the movable jaw is made at the free end of the prismatic portion.

7. A bending machine die according to claim 4, characterized in that:

the pivoting axis for swinging said second hydraulic cylinder comprises a pivot passing through the cylinder rod and engaging coaxial holes in said sustaining means;

guiding means includes a guide symmetrically provided on both said retaining elements of the support in the form of slots; and pin means to engage said retaining end of the movable jaw is made radially projecting from the hydraulic cylinder.

8. A bending machine die according to claim 1, characterized in that said movable jaw includes integrally a clamping portion corresponding to the groove of the die.

9. A bending machine die according to claim 1, characterized in that said movable jaw includes an U-shaped jaw element, inside which the clamping portion is formed in an insert releasably connected to the jaw element.

10. A bending machine die according to claim 9, characterized in that said insert is releasably connected by a key to the jaw element.

11. A bending machine die according to claim 9, characterized in that said insert has on at least one own side a seating for a plate, projecting from said side where the plate is fixed by screws, the projecting plate being designed to be received with its frontal edge in a facing seating made in the die.

12. A bending machine die according to claim 1, characterized in that said movable jaw includes an omega-shaped jaw element, which retains internally a half sleeve, in which a half-tubular insert with clamping portion is engaged.

13. A bending machine die according to claim 12, characterized in that the half-tubular insert is externally provided with a half-circumferential projection designed to be housed into a recess which is made in conformity and in correspondence with the projection inside the half sleeve, so that rotations of the half-tubular insert with respect to the half sleeve are permitted, said rotations being limited by a screw lock passing through a slot of the half sleeve and screwed in a threaded hole of the half-tubular insert.

14. A bending machine die according to claim 4, characterized in that a thrusting lug is provided rigidly projecting from the hydraulic cylinder so that the thrusting lug faces the upper end of the movable jaw to thrust it in an opening operation of the movable jaw.

* * * * *